US005939659A

United States Patent [19]

Dobbins

[11] Patent Number: 5,939,659

[45] Date of Patent: Aug. 17, 1999

[54] GAS OPERATED FORWARD ACTUATING PISTOL

[76] Inventor: Elbert L. Dobbins, P.O. Box 115, Roff, Okla. 74865

[21] Appl. No.: 08/960,068

[22] Filed: Oct. 29, 1997

Related U.S. Application Data

[60] Provisional application No. 60/029,205, Oct. 30, 1996.

[51] Int. Cl.[6] ..... F41A 3/02; F41A 5/26; F41A 5/24

[52] U.S. Cl. ..... 89/161; 89/187.01

[58] Field of Search ..... 89/161, 180, 181, 89/187.01, 186, 170, 173

[56] References Cited

U.S. PATENT DOCUMENTS

| | | | |
|---|---|---|---|
| 663,955 | 12/1900 | Burgess | 89/186 |
| 1,648,833 | 11/1927 | Vincon | 89/181 |
| 3,736,839 | 6/1973 | Childers | 89/128 |
| 3,990,346 | 11/1976 | Irwin | 89/180 |
| 4,028,994 | 6/1977 | Ferluga | 89/161 |
| 4,061,075 | 12/1977 | Smith | 89/132 |

*Primary Examiner*—Charles T. Jordan
*Assistant Examiner*—Christopher K. Montgomery

[57] ABSTRACT

This invention comprises a gas operated forward actuating pistol with a locking bolt to hold the barrel assembly closed until the bullet has passed the port in the barrel. At the passing of the bullet, the gas pressure first moves the lock bolt down freeing the barrel assembly to be pressured forward by the gas pressure. As the barrel assembly moves forward, the extractor/ejector holds the empty cartridge case to be ejected as the barrel clears end of the case. When the barrel reaches the forward stop, a new cartridge rises into position to be chambered as the barrel returns to a lock position with the extractor/ejector spring loaded to a vertical position to ensure chambering.

2 Claims, 1 Drawing Sheet

GAS OPERATED FORWARD ACTUATING PISTOL

This application claims the benefit of U.S. Provisional Application Ser. No. 60/029,205, filed Oct. 30, 1996.

BACKGROUND OF THE INVENTION

1. Field of the Invention

This present invention relates to gas operated forward actuating pistols. In this type pistol the action remains locked until opened and actuated by gas pressure from the firing of the cartridge. It also employs a simplified extractor/ejector assembly.

2. Description of the Related Art

Previously, in pistols of a similar type, the barrel is free to move forward upon firing of the cartridge. This can result in loss of muzzle energy and inhibit reliability. This present invention uses a lock bolt to hold action closed to obtain the greatest advantage.

This present invention is compact, efficient in operation and can protect the user in event the cartridges used are dangerously overloaded. It is intended for the barrel to swell before any danger occurs. This will, due to the design, prevent the pistol from operating as a safety measure. It could also be sealed to prevent entry of debris into the action.

SUMMARY OF THE INVENTION

This invention comprises a gas operated forward actuating pistol having a locked action at time of firing. When the bullet passes a gas port in barrel, gas pressure is directed downward unlocking the barrel assembly. As the lock bolt moves downward, the port to the actuation gas chamber is uncovered allowing gas pressure to push the barrel assembly forward.

The extractor/ejector holds the empty case to be ejected after extraction. It also aids in positive chambering of a new cartridge as it goes to a vertical position when the barrel is forward.

DETAILED DESCRIPTION AND SPECIFICATION OF THE INVENTION

Figure 1:
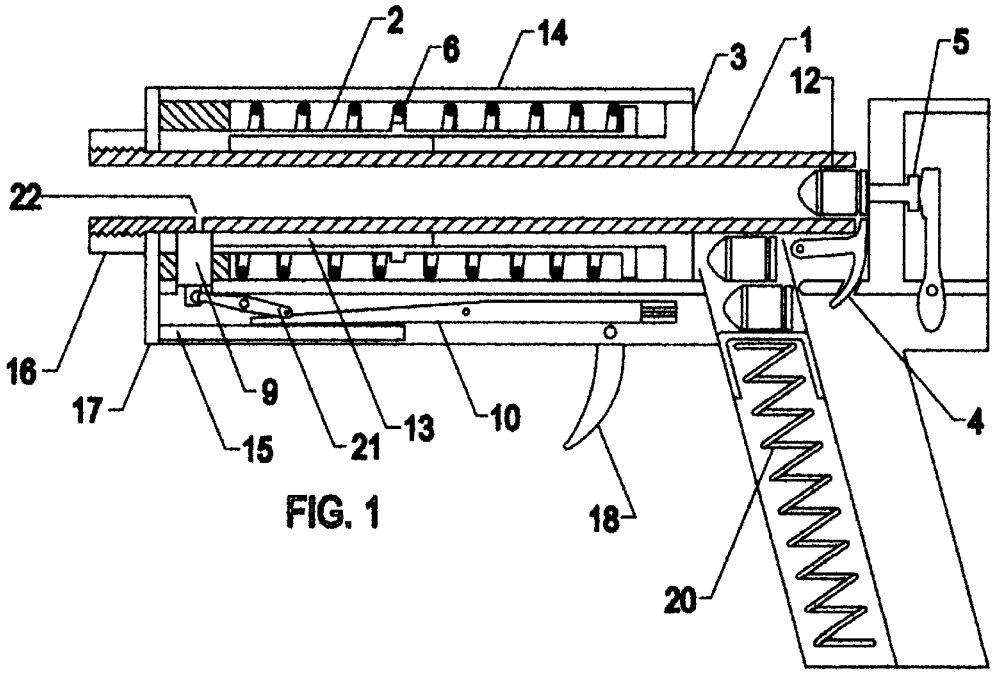
FIG. 1 shows a side sectional view of the pistol with action in a locked position at time of firing.
Figure 2:
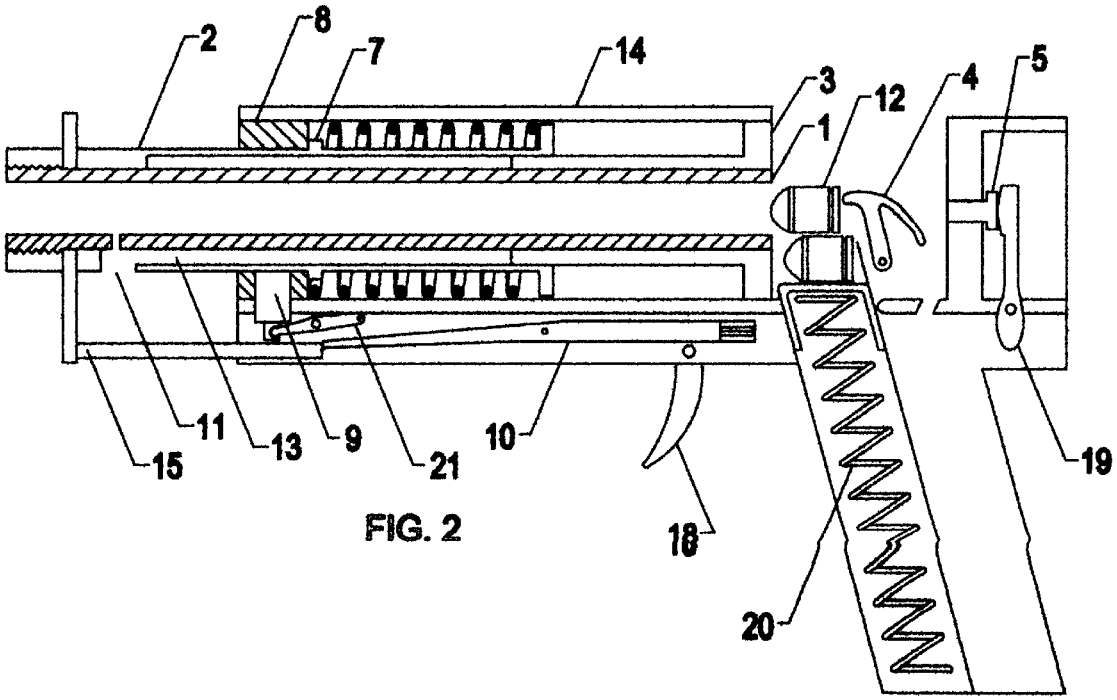
FIG. 2 shows a side sectional view of the pistol with action fully forward and ready to chamber a new cartridge on the way to the lock position.

The pistol of the present invention as shown in FIG. 1 and FIG. 2 has receiver tube 14 holding rear barrel support 3 and breech block 21 in a fixed position. The barrel assembly is comprised of the barrel nut 16 holding the barrel plate 17 and the barrel lock tube 2 to the barrel 1. The guide rod 15 holds the barrel assembly in a proper relationship to the lock bolt 9. The receiver 14, the barrel 1, the rear barrel support 3, and the barrel lock tube 2 are generally circular in cross section and concentric to each other. The receiver nut 8 absorbs impact from the barrel stop 7 and also holds the action spring 6 in tension to the properly return the barrel lock tube 2 to the rear lock position. The lock bolt 9 can be manually unlocked by movement of the operating lever 10 by way of linkage 21. The barrel stop 7 is comprised of a concentric ring around the outside of barrel lock tube 2 and is of a suitable height to avoid interference with the action spring 6.

In operation, when the trigger 18 is pulled causing the hammer 19 to strike the firing pin 5 igniting the cartridge 12, the bullet is forced down the barrel 1. When the bullet passes the gas port 22, the gas pressure forces the lock bolt 9 out of the barrel lock tube recess 11 allowing gas pressure to enter the actuation chamber 13. This forces the barrel assembly to move forward against the spring pressure of the action spring 6. As the barrel assembly moves forward, the fired cartridge case is first extracted, and then ejected by the action of the spring loaded extractor/ejector 4. As the barrel assembly reaches the forward barrel stop 7, a cartridge 12 rises from the magazine 20. The spring loaded extractor/ejector 4 is in a vertical position to aid in the chambering of the cartridge 12. As the barrel 1 returns rearward, the cartridge 12 bears against the extractor/ejector 4, forcing it to a horizontal position. As the lock bolt 9 locks into the lock tube recess 11, the extractor/ejector 4 drops into the extractor groove of the cartridge 12. The extractor/ejector 4 is spring loaded to be in a vertical position and has an arced wing to prevent the interference to proper chambering by an improperly ejected cartridge case. The barrel plate 17 is used for grasping when necessary to open the action. This pistol is intended to be made as a double action only semi-auto, but should not be considered limited to that.

What is claimed is:

1. A gas operated forward actuating pistol comprising:

a) a receiver tube having a solid mounted breech block near the rear of the pistol with a firing pin operated by a trigger pull;

b) a barrel assembly comprised of a barrel, a barrel nut, a barrel plate with a guide rod, and a barrel lock tube;

c) a gas actuation chamber formed between a machined-out area on the inside rear of the barrel lock tube, the exterior of the barrel, and a forward surface of a rear barrel support;

d) a lock bolt, a receiver nut, a lock bolt through hole in the receiver nut, and a lock recess in the barrel lock tube, wherein the lock bolt is disengaged from the lock recess by gas pressure taken off the barrel;

e) a coil action spring positioned between the receiver nut and a rear flange of the barrel lock tube;

f) a barrel plate attached to the barrel between the barrel lock tube and the barrel nut, as a means to manually operate the action;

g) an operating lever used to unlock action by way of a linkage and used to hold action open by way of a linkage to bear against the rear of the guide rod;

h) a combination extractor/ejector having an arced wing, mounted below the barrel and just forward of the breech block, wherein the extractor is spring loaded about an axis to allow it to assume a vertical position to assist in chambering a round, and to allow it to be rotated into a position where it may extract and eject an empty cartridge casing; and a concentric stop ring mounted at a middle portion and on the outside of the barrel lock tube, which limits forward motion of the barrel.

2. A pistol as in claim 1, wherein the action spring limits forward movement of the barrel assembly by compression against a load bearing surface of the rear flange of the barrel lock tube.

* * * * *